United States Patent [19]

Mizuno

[11] Patent Number: 4,930,778

[45] Date of Patent: Jun. 5, 1990

[54] RACKET FRAME

[75] Inventor: Shigeo Mizuno, Hamamatsu, Japan

[73] Assignee: Yamaha Corporation, Japan

[21] Appl. No.: 293,548

[22] Filed: Jan. 4, 1989

Related U.S. Application Data

[63] Continuation of Ser. No. 76,272, Jul. 22, 1987, abandoned.

[30] Foreign Application Priority Data

Jul. 25, 1986 [JP] Japan ..... 61-114212[U]

[51] Int. Cl.[5] ..... A63B 51/10

[52] U.S. Cl. ..... 273/73 D; 273/73 C

[58] Field of Search ..... 273/73 R, 73 C, 73 D, 273/73 B, 73 L

[56] References Cited

U.S. PATENT DOCUMENTS

| | | | |
|---|---|---|---|
| 1,665,598 | 4/1928 | May | 273/73 D |
| 3,567,225 | 3/1971 | Hollis | 273/73 D |
| 3,901,507 | 8/1975 | Ormieres et al. | 273/73 D X |
| 4,462,592 | 7/1984 | Legger et al. | 273/73 D |
| 4,591,165 | 5/1986 | Sines et al. | 273/73 D |

FOREIGN PATENT DOCUMENTS

| | | | |
|---|---|---|---|
| 0104930 | 4/1984 | European Pat. Off. | 273/73 R |
| 2270908 | 12/1975 | France | 273/73 C |

*Primary Examiner*—Edward M. Coven
*Assistant Examiner*—William E. Stoll
*Attorney, Agent, or Firm*—Lerner, David, Littenberg, Krumholz & Mentlik

[57] ABSTRACT

A racket frame having an oval head holding strings in tension via string holes formed therethrough, the string holes are selectively enlarged in transverse cross section on the side of the inner peripheral surface of the head for enlargement in effective surface area, free sweet spot adjustment and clear positioning of spots of vibration.

4 Claims, 3 Drawing Sheets

RACKET FRAME

This is a continuation of application Ser. No. 07/076,272 filed July 22, 1989, now abandoned.

BACKGROUND OF THE INVENTION

The present invention relates to an improved racket frame, and more particularly relates to improvements in an FRP racket frame having a face formed by a latticework of strings held in tension on a substantially oval head.

Recent development of racket frames covers a wide variety of types from wooden through metallic to FRP racket frames. Concurrently, a wide variety of materials have been used for strings forming the face of a racket frame. In the case of an FRP racket frame, a foam resin core is wholly embraced by an FRP shell.

The most conventional FRP racket frames have a common, general construction in which a head coupled to a grip via a yoke has a substantially oval shape defining a face formed by a latticework of strings held in tension on the head. The head includes a pair of opposite longitudinal center zones located astride the longer axis of the oval, a pair of lateral center zones located astride the shorter axis of the oval, and four intermediate zones interspacing adjacent center zones. The head also has inner and outer peripheral surfaces substantially parallel to each other, both perpendicularly intersecting the plane of the face. The head is provided with the first group of through, string holes each of which extends parallel to the longer axis of the oval and opens in the inner and outer peripheral surfaces of the head. The head is further provided with the second group of through, string holes each of which extends parallel to the shorter axis of the oval and opens in the inner and outer peripheral surfaces of the head. Each string is held in tension on the head in an arrangement such that, in a circumferential groove formed in the outer peripheral surface of the head, the string runs in the circumferential direction astride the section of the outer peripheral surface between a pair of adjacent string hole of a same group. A string protector is inserted into each string hole for protection of the associated string from vibrations caused by striking balls. This string protector is comprised of a flange section resting in the circumferential groove in the outer peripheral surface and a tubular section inserted into the string hole and projecting somewhat from the inner peripheral surface of the head.

When a string vibrates in a direction perpendicular to the face of the racket frame due to striking balls, its knot of vibration is located at the inner end of the associated string hole or at the inner end of the associated string protector and the vibrating string impinges against such a knot of vibration. As a consequence, the string span is limited by the dimension of the inner peripheral surface of the head or by the dimension of the contour defined by the inner ends of the string protectors. This restricts enlargement in effective surface area of the face of the racket frame, in particular free adjustment in sweet spot, thereby seriously deteriorating feel at striking. Such impingement further makes the position of the knot of vibration quite ambiguous.

SUMMARY OF THE INVENTION

It is the object of the present invention to assure free adjustment in sweet spot through an enlarged effective surface area and clear positioning of the knot of vibration.

In accordance with the basic aspect of the present invention, each string hole is provided with a divergencce on the side of the inner peripheral surface of the head.

DESCRIPTION OF THE PREFERRED EMBODIMENTS

Figure 1:
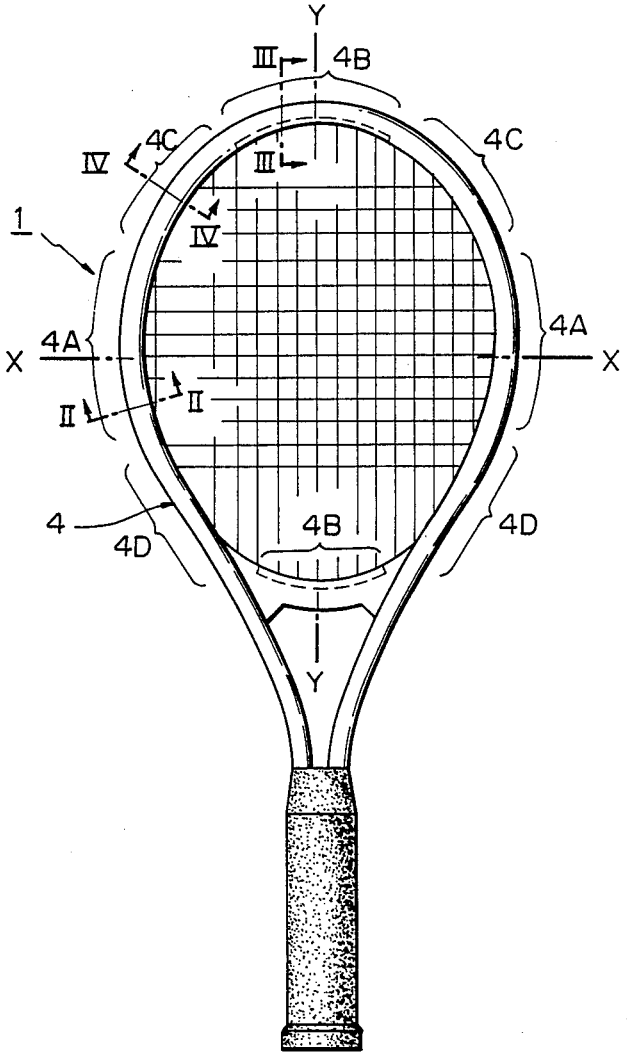
FIG. 1 is a perspective view of one example of the racket frame to which the present invention is advantageously applied.

In FIG. 1 a head 4 of the racket frame 1 of the present invention is provided, like the conventional ones, a pair of opposite longitudinal center zones 4B located astride the longer axis Y of the oval, a pair of lateral center zones 4A located astride the shorter axis X of the oval, and four intermediate zones 4C and 4D.

Figure 2:
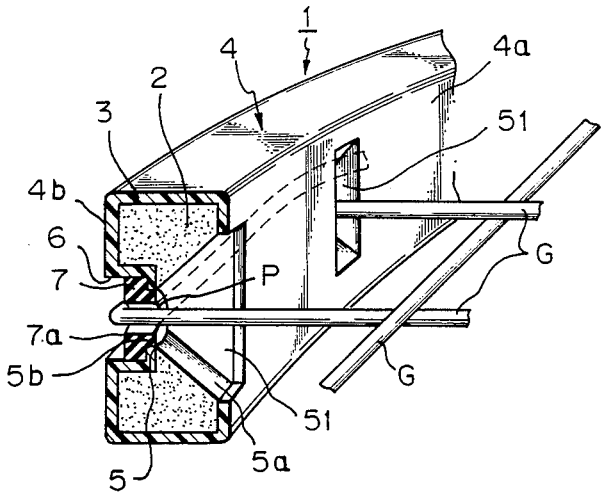
FIG. 2 is a partly sectional perspective view of one embodiment of the racket frame of the present invention taken along a line II—II in FIG. 1, FIGS. 3 and 4 are sections taken along lines III—III and IV—IV in FIG. 1, respectively.
Figure 3:
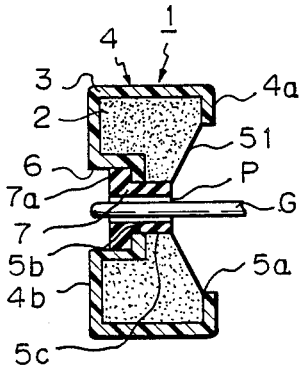
Figure 4:
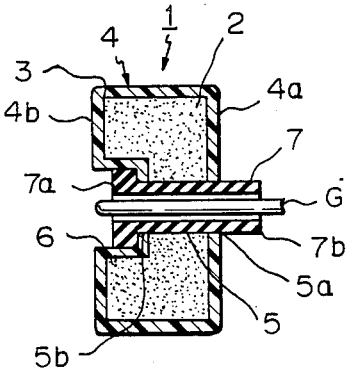

One embodiment of the racket frame in accordance with the present invention is shown in FIGS. 2 through 4. The head 4 has parallel inner and outer peripheral surfaces **4*a* and 4*b*, both perpendicularly intersecting the plane of the face. The head 4 is provided with string holes 5 which extend through a synthetic resin core 2 and an FRP shell 3 of the head 4. These string holes 5 are directed substantially parallel to the longer axis Y or the shorter axis X of the oval, and open in the inner and outer peripheral surfaces 4*a* and 4*b*. Each string G is held in tension on the head 4 in an arrangement such that, in a circumferential groove 6 in the outer peripheral surface 4*b*, the strings G run in the circumferential direction astriding the section of the outer peripheral surface 4*b* between a pair of adjacent string holes 5. In the case of this embodiment, each string hole 5 has an inner opening 5*a* in the inner peripheral surface 4*a*, an outer opening 5*b* in the outer peripheral surface 4*b*, an intermediate section 5*c* between the two openings 5*a* and 5*b*, and a divergence 51 intervening between the intermediate section 5*c* and the inner opening 5*a*. As best seen in FIG. 3, a string protector 7 has a flange section 7*a* resting in the outer peripheral surface 4*b* coaxially with the outer opening 5*b* of an associated string hole 5, and a tubular section 7*b* inserted into the intermediate section 5*c* of the string hole 5**.

Each string hole 5 is provided with the above-described divergence 51 in the lateral and longitudinal center zones 4A and 4B shown in FIG. 1. In the intermediate zones 4C and 4D, however, the string hole 5 may be provided with the conventional construction such as shown in FIG. 4.

With the construction shown in FIG. 3, the knot of vibration P is clearly located at the inner end of the intermediate section 5C of the string hole 5 but not at the inner opening **5*a*. Thus the effective surface area can be enlarged due to presence of the divergence 51**, thereby assuring free adjustment in sweet spot.

Figure 5:
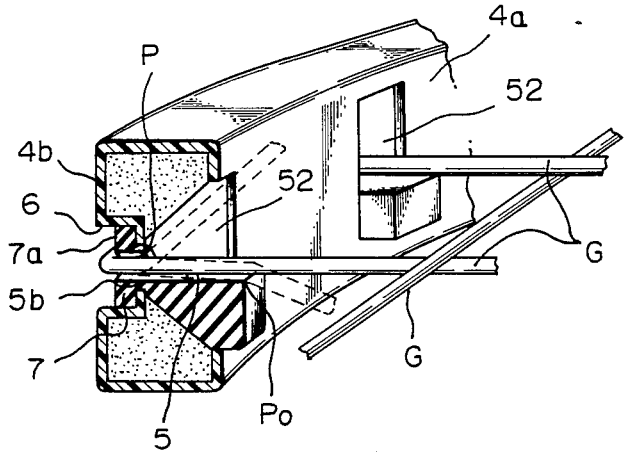
FIG. 5 is a partly sectional perspective view of another embodiment of the racket frame of the present invention.

In the case of another embodiment of the racket frame of the present invention shown in FIG. 5, an asymmetric divergence 52 is formed on one side of the center axis of the string hole 5 so that two different knots of vibration P and $P_o$ should be provided. In the case of the illustrated example, one knot of vibration P is located at the inner end of the intermediate section 5C and the other knot of vibration $P_o$ is located at the inner opening 5*a* of the string hole 5.

Figure 6:
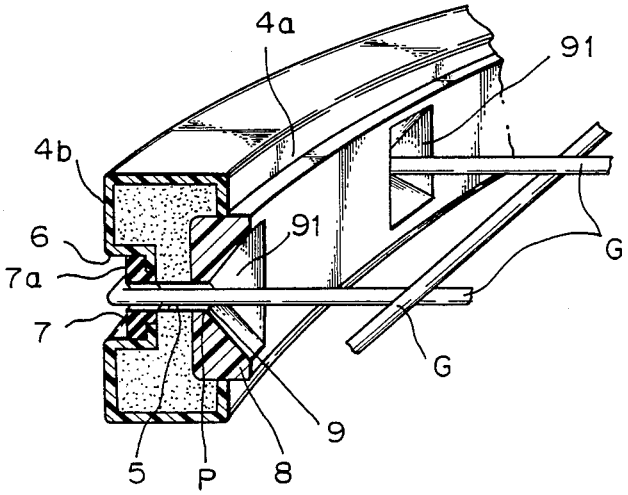
FIG. 6 is a partly sectional perspective view of the other embodiment of the racket frame of the present invention.

The other embodiment of the racket frame of the present invention is shown in FIG. 6, in which an additional string protector 8 made of synthetic resin is attached to the inner peripheral surface 4*a* of the head 4 with its string hole 9 coaxially with the string hole 5 in the head 4. The string hole 9 terminates in a divergence 91.

I claim:

1. An improved racket frame comprising a head having inner and outer peripheral surfaces, said head extending in a predetermined plane, said head having a first side and a second side on either side of said predetermined plane and a plurality of string holes extending between said inner and outer peripheral surfaces, each said string hole having an opening which terminates at a point which is displaced outwardly from said inner peripheral surface and which is asymmetric in configuration with respect to said predetermined plane of said racket frame, and including an outwardly divergennt surface diverging outwardly from said predetermined plane on said first side of said head in a direction facing inwardly along said predetermined plane and a substantially planar surface parallel to said predetermined plane on said second side of said head, whereby first and second knots of vibration are provided in the directions of said first and second sides of said racket head, respectively, said first and second knots of vibration being displaced from each other along said plane, and a plurality of strings held in tension on said head in engagement with said string holes.

2. An improved racket frame comprising a head having an inner peripheral surface and an outer peripheral surface, said head extending parallel to a predetermined plane and having a first side and a second side on either side of said predetermined plane, a plurality of string holes extending between said inner peripheral surface and said outer peripheral surface, said string holes terminating at a point which is displaced outwardly from said inner peripheral surface, a string protector attached to said inner peripheral surface, said string protector having a plurality of openings in its inner surface, said plurality of openings being displaced outwardly from said inner peripheral surface, each said opening being asymmetric with respect to said predetermined plane of said racket frame and oriented in line with each said string hole in said head, and including an outwardly divergent surface diverging outwardly from said predetermined plane on said first side of said head in a direction facing inwardly along said predetermined plane and a substantially planar surface parallel to said predetermined plane, whereby two different knots of vibration are provided displaced along said plane, and a plurality of strings held in tension on said head in engagement with said string holes.

3. The improved racket frame of claim 1 having a substantially oval shape thereby providing a longer dimension diameter and a shorter dimension diameter, said racket frame including a first axis parallel to said predetermined plane and extending along said longer dimension diameter and a second axis parallel to said predetermined plane and extending transverse to said first axis, and defining four intermediate zones between the opposite ends of said first and second axes, said plurality of string holes being located substantially within the areas defined by said first and second axes, and including a second plurality of string holes substantially included in said four intermediate zones, said second plurality of string holes extending between said inner and outer peripheral surfaces and having an opening which extends between said inner and outer surfaces and therefore includes a node of vibration substantially coextensive with said inner surface.

4. The improved racket frame of claim 2 having a substantially oval shape thereby providing a longer dimension diameter and a shorter dimension diameter, said racket frame including a first axis parallel to said predetermined plane and extending along said longer dimension diameter and a second axis parallel to said plane and extending transverse to said predetermined first axis, and defining four intermediate zones between the opposite ends of said first and second axes, said plurality of string holes being located substantially within the areas defined by said first and second axes, and including a second plurality of string holes substantially included in said four intermediate zones, said second plurality of string holes extending between said inner and outer peripheral surfaces and having an opening which extends between said inner and outer surfaces and therefore includes a node of vibration substantially coextensive with said inner surface.

* * * * *

UNITED STATES PATENT AND TRADEMARK OFFICE

CERTIFICATE OF CORRECTION

PATENT NO. : 4,930,778

DATED : June 5, 1990

INVENTOR(S) : Shigeo Mizuno

It is certified that error appears in the above-identified patent and that said Letters Patent is hereby corrected as shown below:

Column 1, line 5, delete "1989" and substitute therefor --1987--.

Column 4, line 39, before "plane" insert --predetermined--.

Column 4, line 39, following "to said" delete "predetermined".

Signed and Sealed this

Tenth Day of December, 1991

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,930,778

DATED : June 5, 1990

INVENTOR(S) : Shigeo Mizuno

It is certified that error appears in the above-identified patent and that said Letters Patent is hereby corrected as shown below:

Column 1, line 5, delete "1989" and substitute therefor --1987--.

Column 4, line 39, before "plane" insert --predetermined--.

Column 4, line 39, following "to said" delete "predetermined".

Signed and Sealed this

Twenty-fifth Day of August, 1992

*Attest:*

DOUGLAS B. COMER

*Attesting Officer*

*Acting Commissioner of Patents and Trademarks*